US006729472B2

(12) United States Patent
Stucke et al.

(10) Patent No.: US 6,729,472 B2
(45) Date of Patent: May 4, 2004

(54) CONTAINER ASSEMBLY AND NESTING SET THEREOF

(75) Inventors: Donald Stucke, East Aurora, NY (US); Ronald G. Kishbaugh, Elmira, NY (US)

(73) Assignee: WKI Holding Company, Inc., Reston, VA (US)

( * ) Notice: Subject to any disclaimer, the term of this patent is extended or adjusted under 35 U.S.C. 154(b) by 0 days.

(21) Appl. No.: 10/044,833

(22) Filed: Jan. 11, 2002

(65) Prior Publication Data

US 2002/0092790 A1 Jul. 18, 2002

Related U.S. Application Data

(60) Provisional application No. 60/261,627, filed on Jan. 12, 2001.

(51) Int. Cl.[7] ..... B65D 21/00
(52) U.S. Cl. ..... 206/515; 220/23.88
(58) Field of Search ..... 220/574, 23.88, 220/796, 805; 206/516

(56) References Cited

U.S. PATENT DOCUMENTS

| | | | | |
|---|---|---|---|---|
| 3,079,037 A | | 2/1963 | Schechter | 220/212 |
| 3,080,090 A | | 3/1963 | Young | |
| 3,107,028 A | | 10/1963 | De Robertis | 220/212 |
| 3,349,941 A | * | 10/1967 | Klanderer | 220/23.88 |
| 3,365,092 A | * | 1/1968 | Blessing | 220/23.88 |
| 3,445,050 A | * | 5/1969 | Peters et al. | 220/23.88 |
| 3,447,714 A | | 6/1969 | Elliot | |
| 3,448,888 A | | 6/1969 | Smith et al. | |
| 3,460,711 A | | 8/1969 | Al-Roy | |
| 3,504,823 A | | 4/1970 | Logomasini | |
| 3,989,142 A | | 11/1976 | Gwilliam, Jr. et al. | |
| 4,047,329 A | | 9/1977 | Holt | 220/212 |
| 4,762,248 A | | 8/1988 | Uhlig | 206/508 |
| 4,844,263 A | | 7/1989 | Hadtke | |
| 4,847,459 A | * | 7/1989 | Desai | 220/573.1 X |
| 5,624,051 A | * | 4/1997 | Ahern, Jr. et al. | 220/805 X |
| 5,769,229 A | | 6/1998 | Andress et al. | |
| 5,799,792 A | | 9/1998 | Abrums | 220/212 |
| 6,164,483 A | | 12/2000 | Walker | 220/212 |

* cited by examiner

*Primary Examiner*—Nathan J. Newhouse
(74) *Attorney, Agent, or Firm*—Seyfarth Shaw LLP

(57) ABSTRACT

A container assembly is provided, including a container and a flexible lid. The container includes a base, and a sidewall extending upwardly and outwardly from the periphery of the base toward an open upper end defining a container opening. A rounded-ridge extends upwardly outward from the upper end. The flexible lid has an inner rim and an outer rim. An interior portion of the inner rim forms a mechanical lock with a peripheral edge on the lower base of the container thereby preventing loss of the lid, while also providing a more stable container assembly. The outer rim forms a mechanical lock with the rounded ridge to close the upper end of the container during use.

10 Claims, 5 Drawing Sheets

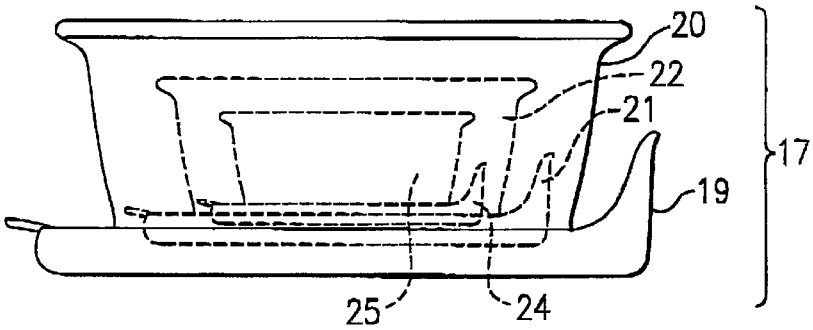
FIG.7
FIG.8
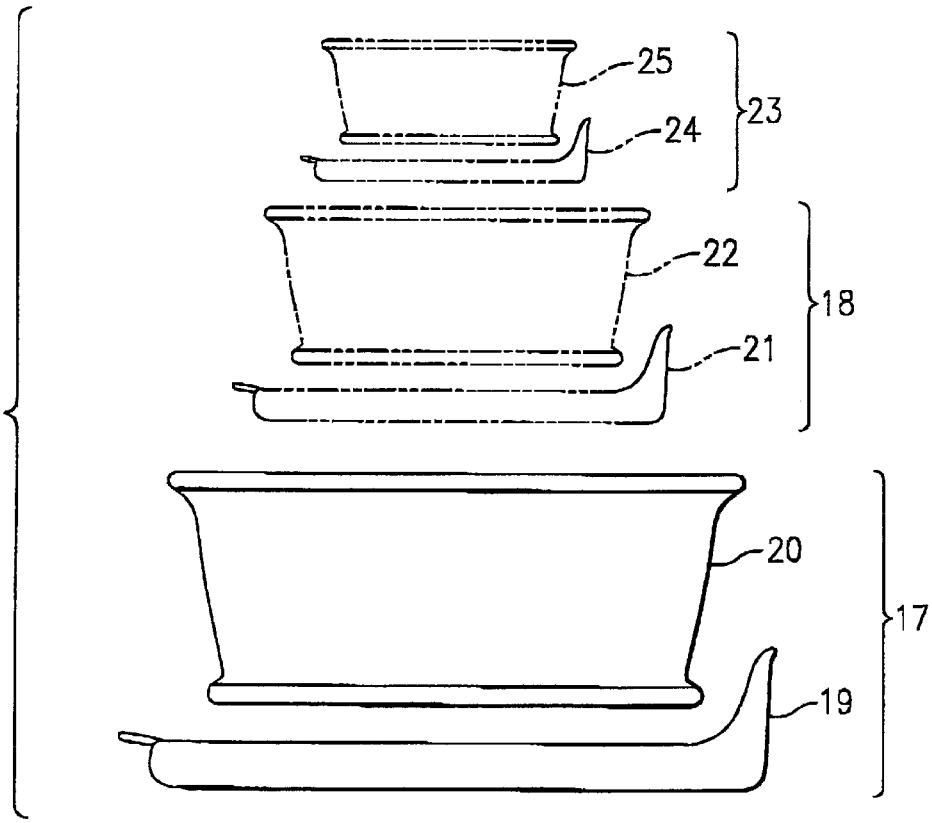

CONTAINER ASSEMBLY AND NESTING SET THEREOF

CROSS REFERENCE TO RELATION APPLICATION

This application claims the benefit of U.S. Provisional Application Serial No. 60/261,627 filed Jan. 12, 2001.

FIELD OF THE INVENTION

The present invention relates generally to a container assembly having a container and a lid that can be secured to the base of the container when not in use, and a set of container assemblies each including a container and a matching lid, wherein the container assemblies are capable of being stacked on and nested within one another.

BACKGROUND OF THE INVENTION

Container assemblies consisting of a lid and a container are known. These products have many applications, but are particularly useful for food storage. When not in use, assemblies that can be nested within one another are preferred, but must be stable when stored within one another so that they do not separate unintentionally. Further, container assemblies that are stackable upon one another during use (to reduce the amount of space required to store the stacked containers) must also be stable to avoid spilling the contents of the containers.

Consumers demand containers which come in a variety of shapes and volumetric sizes. Such variations in shapes and sizes, however, create problems with designing container assemblies that are both nestable and stackable. That is, containers which easily nest with one another are usually not easy to stack and vice-versa.

Although container assemblies that nest within one another for compact storage, or that stack upon one another, are known, drawbacks exist. For example, since storage containers are widely used to transport food between locations, one drawback of prior art containers is that the lids are often mismatched, lost or misplaced when removed from the corresponding container. Without a lid, the sealed, self-contained portability function of the assembly is substantially reduced, and the contents may be subject to spilling or contamination. Further, without a properly fitted lid on one container, it is difficult to stably stack another item on that container.

Additionally, many containers are inherently unstable, or otherwise susceptible to tipping when stacked. This problem reduces stackability and leads to inefficient use of available storage space, and can contribute to the loss of stored goods if the stack shifts or becomes dislodged.

Further, many known nesting container assemblies have flaws which limit their use. For example, with many nesting assemblies, it is difficult to retrieve a lid when nested since lids tend to remain inside the next largest size container. Moreover, if the user chooses not to nest the containers when not in use, the containers must be stacked during this storage period. This is problematic since the height of the stack increases as containers are added. This significantly reduces the number of containers which may be stored within a given storage space, especially when the height of the storage space is limited.

Accordingly, it would be desirable to provide a container assembly having a lid which may be mechanically locked to the base of a corresponding container and which can be nestably received as a container-lid assembly unit within another container assembly of the set. It would also be desirable to provide a set of container assemblies which may be nested completely within the largest container of the set. Additionally, it would be desirable for each container assembly of the set to be individually retrievable from a nested configuration as a unit, including both the container and the corresponding lid. Further, it would be desirable to provide a set of container assemblies that facilitate overall stacking stability, when the stacked containers are empty or full.

SUMMARY OF THE INVENTION

It is an object of the present invention to overcome the drawbacks of the prior art. Accordingly, it is an object of the present invention to provide a container assembly in which the lid is locked onto the base of the container when the container is not in use, thereby preventing loss of the lid and providing easy retrieval of the complete container assembly from the nested configuration. A further object of the invention is to provide a set of container assemblies which offer highly compact storage, since the height of the nested set is equal to the height of the largest container assembly when its lid is locked to its base.

In accordance with an embodiment of the present invention, a container assembly is provided which includes a container having a base and a sidewall. The sidewall has an inner surface and an outer surface and extends upwardly and outwardly from the base toward an upper end. The upper end defines an opening in the container which is bound by the sidewall and the base. The upper end has a rounded ridge extending therefrom and the base has a peripheral edge. The assembly also includes a flexible lid having a first rim and a second rim, with the first and second rims being radially spaced from one another and extending downwardly from an undersurface of the lid. During storage, the lid attaches to the container in a first position proximate the peripheral edge of the base via the first rim, and, during use, the lid attaches to the container at a position proximate the rounded ridge of the upper end of the sidewall via the second rim, thereby covering the opening in the upper end of the container. In this way, the lid can be secured to the base of the container when not in use to avoid loss. In addition, the lid can also be secured to the base of the container to enhance the lateral stability of the container by increasing the footprint of the overall container. This is especially useful when serving contents from the container while it is positioned on a table, for example.

In accordance with another embodiment of the invention, a plurality of the container assemblies are dimensioned so as to nest within one another when not in use. The height of each container is also selected such that the overall height of the nested containers does not exceed the height of the tallest container of the set.

Additional objects, advantages, and other novel features of the invention will become apparent to those skilled in the art upon examination of the detailed description and drawings that follow.

BRIEF DESCRIPTION OF THE DRAWINGS

For a fuller understanding of the nature and objects of the present invention, reference should be made to the following detailed description of a preferred mode of practicing the invention, read in conjunction with the accompanying drawings, in which:

FIG. 7 is a side view, partly in phantom, of a set of container assemblies with lids attached to the peripheral edge of each base, nested within one another;

FIG. 8 shows an exploded side view, with parts in phantom, of three disassembled container assemblies in pre-nesting position with respect to one another;

DETAILED DESCRIPTION OF THE INVENTION

Figure 1A:
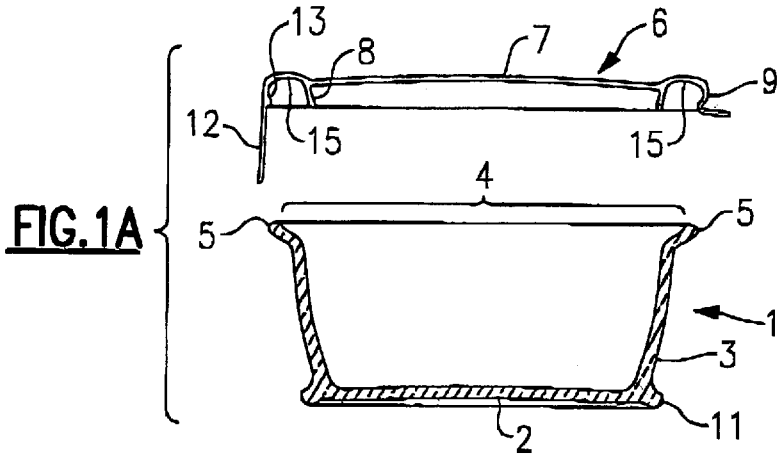
FIG. 1A is an exploded cross-sectional view of a container assembly, according to the invention, with the lid positioned above the opening of the container.

FIG. 1A shows a container assembly in accordance with the present invention. The assembly includes a container body 1 and lid 6 which comprise one of the container assemblies of the present invention. The lid 6 and container 1 can be formed into virtually any corresponding geometric shape or volumetric size desired. For purposes of description only, the figures show a substantially disc-shaped lid and a container in the shape of an inverted truncated cone.

Figure 2:
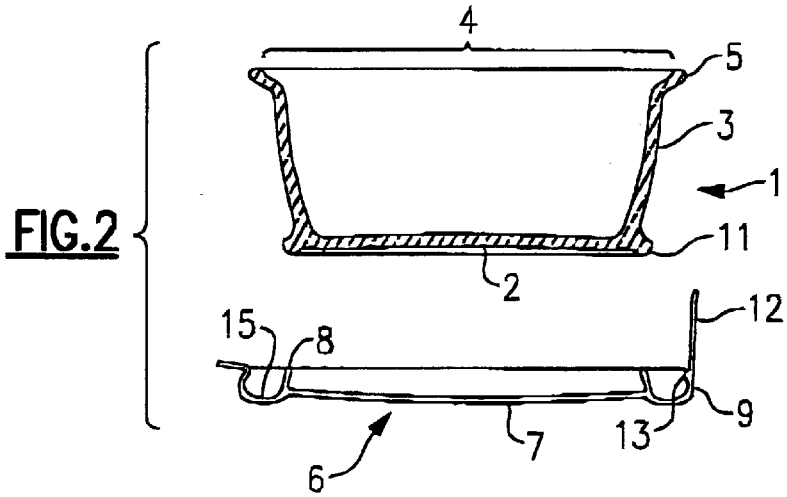
FIG. 2 is an exploded cross-sectional view of the container assembly of FIG. 1A with the lid in an inverted position below the base of the container body.
Figure 3:
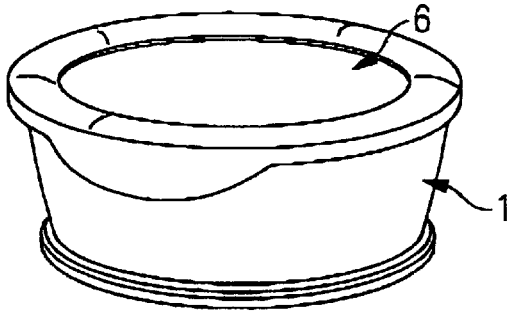
FIG. 3 is a perspective view of the container shown in FIG. 1A with the lid assembled to the rounded ridge.
Figure 4:
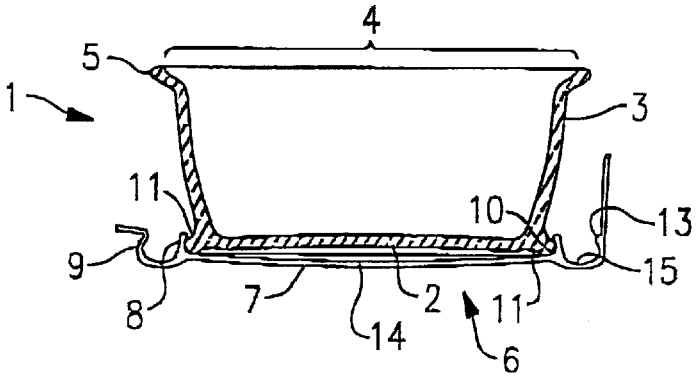
FIG. 4 is a cross-sectional view of the container with the lid assembled to the bottom peripheral edge.

The container can be made of any known container material, including for example, glass, plastic, or PYREX®. As shown in FIGS. 1A, 2 and 4, the container 1 comprises a base 2, and a sidewall portion 3 extending upwardly and outwardly from the periphery of the base 2 to an open upper end 4 defining a container opening. A rounded ridge 5 extends upwardly and outwardly from the open upper end 4. The lower portion of the base 2 also includes a peripheral edge 11.

The lid 6 can be made of any known lid material. Typically a semi-rigid plastic is employed. The lid 6 is used for closing the open upper end 4 of the container 1. As shown in FIGS. 1A, 1B, 1C, 2 and 4, the lid 6 comprises a substantially planar upper surface 7, an inner rim 8 and an outer rim 9. As shown, the outer rim 9 is integral with and extends substantially vertically downward from the periphery of an under surface 14 (FIG. 1B) of the lid 6. The inner rim 8 is also integral with and extends downward from the under surface 14 from an annular position that is spaced radially inward from the outer rim 9. Preferably, the inner rim 8 is inclined slightly toward the center of the lid 6.

As shown in FIG. 4, the inner surface 10 of the inner rim 8 forms a mechanical lock with the peripheral edge 11 of the base 2. By locking the lid 6 to the base 2 of the container 1, the overall stability of the container portion of the assembly is improved. In addition, the locking action prevents the lid 6 from becoming lost or misplaced. Locking the lid 6 to the base 2 also prevents contact between adjacent containers when the containers are nested within each other. This also helps to avoid chipping of the base when the container is made of fragile material.

As shown in FIGS. 1A, 2, and 4, the rounded ridge 5 on the upper end of the sidewall 3 substantially conforms to the shape of the inner surface of outer rim 9. Preferably, the inner 8 and outer 9 rims are constructed of a flexible material, which easily allows a union between the peripheral edge 11 and rounded ridge 5, respectively. Preferably, the inner surface of the outer rim 9 grips the ridge 5 to form a close-fitting peripheral seal between the container 1 and the lid 6, thereby locking the lid 6 to the open upper end 4 of the container 1. Consequently, as shown in FIGS. 1–4, the lid 6 forms a mechanical lock with either the peripheral edge 11 on the lower base 2 (during storage), or with the ridge 5 of the open upper end 4 of the sidewall 3 (during use).

Figure 1B:
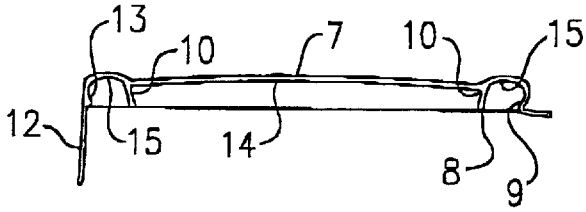
FIG. 1B is a cross-sectional view of the lid shown in FIG. 1A.
Figure 1C:
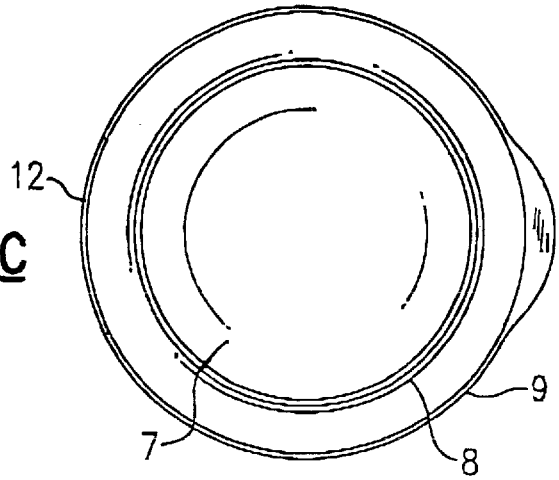
FIG. 1C is a bottom view of the lid shown in FIG. 1A.

Optionally, as shown in FIGS. 1A, 1B and 2, the lid 6 may include a downwardly-extending, lifting flange 12, to aid in removing the lid 6 from the container 1. Preferably, this lifting flange 12 integrally depends from the outer rim 9, and is located outside the open upper end 4 of the sidewall 3 when the lid 6 is assembled to the container 1. Application of an upward force by the user to this flange 12 makes removal of the lid 6 an easy task. Further, an inward projection 13 may be included between the outer rim 9 and the lifting flange 12 which cooperates with the inner rim 8 to more securely lock the lid 6 to the container 1.

It should be noted that the peripheries of the inner rim 8 and the outer rim 9 are preferably substantially concentric, and the periphery of the inner rim 8 is dimensionally less than the periphery of the outer rim 9. As FIG. 1B illustrates, the diameter of the rounded ridge 5 is greater than the outer diameter of the inner rim 8, and slightly less than the inner diameter of the outer rim 9. As shown in FIG. 1A, this ensures that the rounded ridge 5 mates with the inner surface of outer rim 9. As shown in FIGS. 1B and 4, the diameter of the peripheral edge 11 is slightly less than the diameter of the inner rim 8 to ensure that the peripheral edge 11 and the inner rim 8 form a mechanical lock when assembled together.

Although not shown in the drawings, an additional annular sealing rib can be provided in area 15 between inner rim 8 and outer rim 9. In this case, the sealing rib should be inwardly spaced from outer rim 9 over a distance that roughly corresponds to the thickness of the ridge 5 proximate the open end 4 of the container. Providing an additional annular sealing rib in this manner facilitates a better seal between lid 6 and the open end 4 of container 1.

Figure 6:
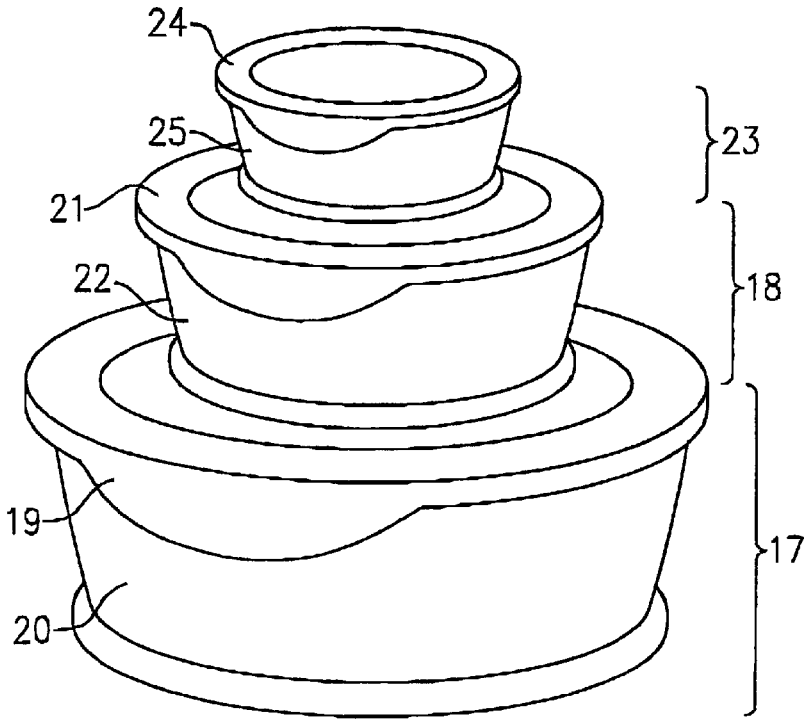
FIG. 6 is a perspective view of three container assemblies stacked upon one another.

According to another embodiment of the present invention, a set of containers including a plurality of the individual container assemblies of varied sizes is provided. The above discussed container assembly is designed to be included in a set of substantially identically shaped container assemblies of varied, and preferably graduated, volumetric size. As shown in FIG. 6, three container assemblies 17, 18 and 23 are stacked with the peripheral edge of the base of one container resting upon the lid of the next largest assembly. For example, the base of container 22 rests on the lid 19 of assembly 17, and the base of container 25 rests on the lid 21 of the assembly 18. It should be noted that there is no theoretical limit to the number of assemblies which may be stacked upon or nested within one another. However, for purposes of description herein, a set consisting of three container assemblies will be referenced.

Figure 5:
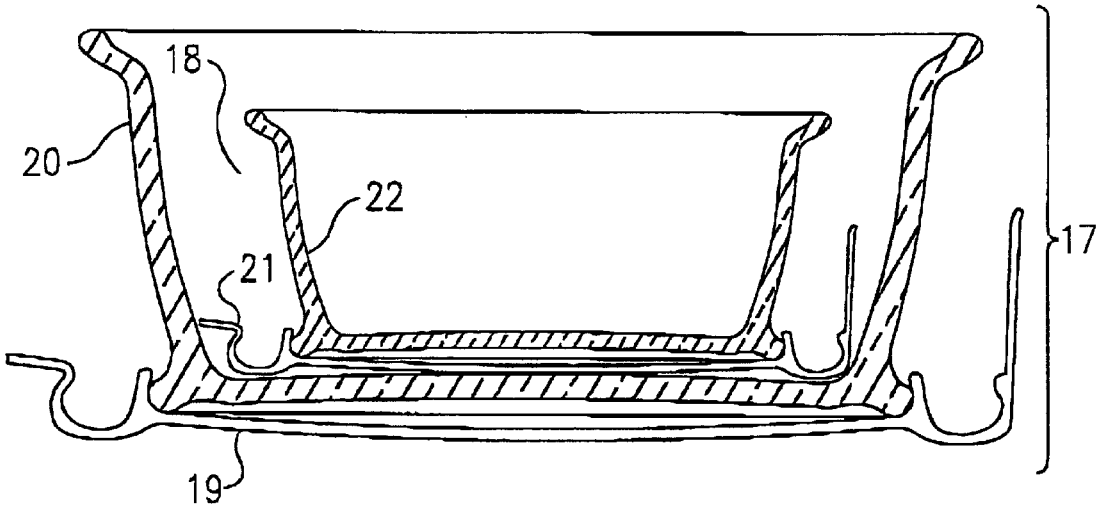
FIG. 5 shows a cross-sectional view of two containers nested within one another with lids attached to their respective peripheral edges.

FIG. 5 shows a nesting configuration of the container assemblies having lids assembled to the bases of each container. A first container assembly 17 according to the above described container assembly is shown, as well as a second container assembly 18 having a structure substantially identical to that of the first container assembly 17, but having a smaller volumetric size. As shown in FIG. 5 the second container assembly 18 is nestably received within the first container assembly 17. This first container assembly 17 comprises a first lid 19 and a first container 20, and the second container assembly 18 comprises a second lid 21 and a second container 22. As further illustrated in FIGS. 7 and 8, by making the outer diameter of lid 21 slightly smaller than the inner diameter of container 20, the second container assembly 18 is completely receivable within the first container assembly 17, even when the second lid 21 is assembled to the peripheral edge of the base of the second container 22. This also prevents direct contact between the containers 20 and 22 of the set. In addition, this relationship makes it easy to retrieve a complete container assembly unit from a nested set since the lid is locked to the base of its matching container.

Additionally, the lid of the present invention will not adhere to the base of a larger container during storage, which also increases the ease of removing a complete container assembly unit from the nested set. Further, the height of each container assembly is selected such that the entire set, when nested, is at most equal to the height of the largest container assembly 17. In this manner, the set of container assemblies shown offers highly compact storage capabilities.

As shown in FIG. 6, a third container assembly 23 may also be included in the set, having a third lid 24 assembled to cover the open upper end of the third container 25. This third container assembly can also be nestably received within the second container assembly 18 when the third lid 24 is assembled to the base of the third container 25 as shown in FIG. 8. Again, regardless of the number of assemblies employed, the height of the entire set when nested is at most equal to the height of the largest container assembly.

Figure 9:
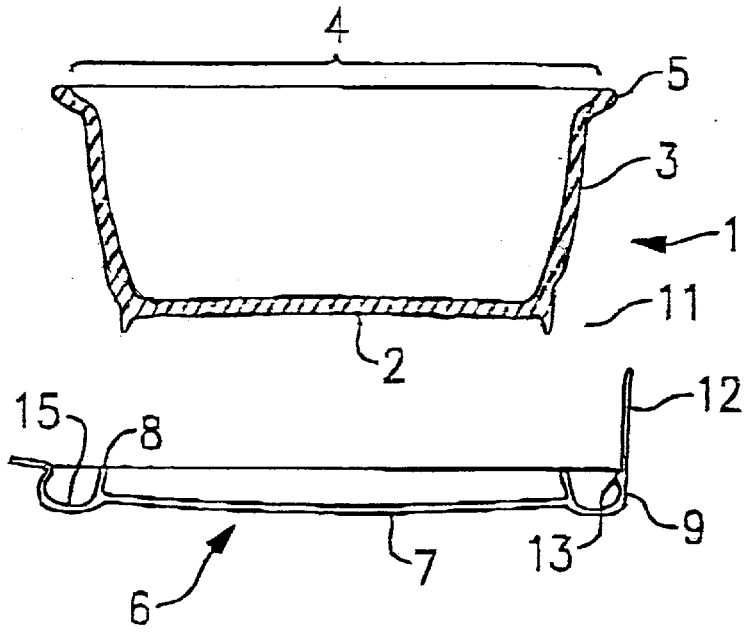
FIG. 9 shows an alternative embodiment of the container assembly according to the present invention.

FIG. 9 shows an alternative embodiment of the container assembly shown in the prior drawings. The only significant difference between this embodiment and the prior embodiment is that the peripheral edge 11 of base 2 does not project outwardly therefrom. Instead, the peripheral edge 11 simply projects downwardly from base 2, and the dimension of inner rim 8 of lid 6 is selected to provide a friction engagement with peripheral edge 11. It is also possible that peripheral edge 11 does not extend from the container (i.e., it forms a smooth transition between the side wall and bottom of the container).

Figure 10:
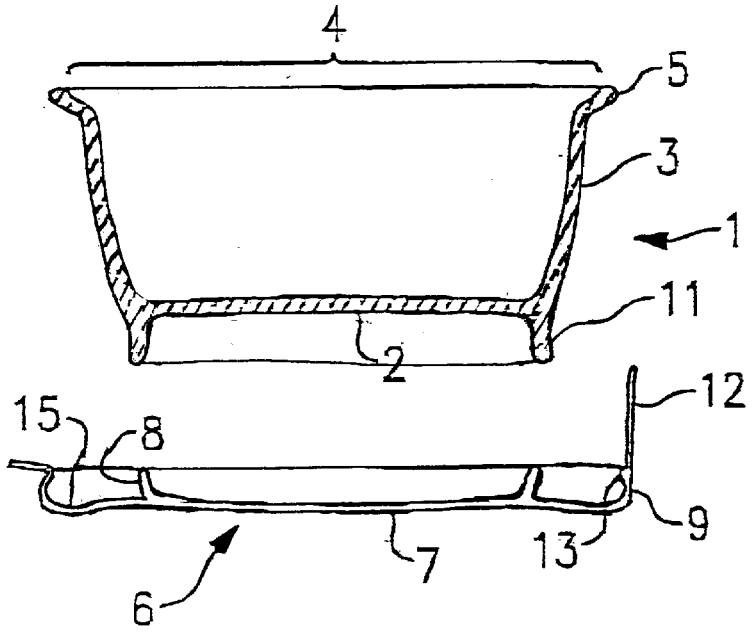
FIG. 10 shows yet another alternative embodiment of the container assembly according to the present invention.

FIG. 10 shows yet another alternative embodiment of the present invention, wherein peripheral edge 11 of base 2 extends downwardly from the bottom of base 2 a considerable length (similar to the bottom of a traditional rice bowl). In this embodiment, inner rim 8 would be inclined slightly away from the center of lid 6 and be dimensioned to grip the inner surface of peripheral edge 11 of base 2.

While the present invention has been particularly shown and described with reference to the preferred mode as illustrated in the drawings, it will be understood by one skilled in the art that various changes in detail may be effected therein without departing from the spirit and scope of the invention as defined by the claims.

What is claimed is:

1. A container assembly comprising:

a container having a base and a sidewall, said sidewall having an inner surface and an outer surface and extending upwardly and outwardly from said base toward an upper end, said upper end defining an opening in said container bounded by said sidewall and said base, said upper end having a rounded ridge extending therefrom and terminating at an upper outermost end, and said base having a peripheral edge extending outwardly and downwardly of the side wall and terminating at a lower outermost end below the base; and a flexible lid having a first rim and a second rim, said first and second rims being radially spaced from one another and extending downwardly from an undersurface of said lid, said lid being attachable to said container in at least a first position proximate said peripheral edge of said base via said first rim, and at least a second position proximate said rounded ridge of said upper end of said sidewall via said second rim thereby covering said opening in said upper end of said container, the lid engaging only the lower outermost end in the first position and only the upper outermost end in the second position.

2. The container assembly of claim 1, wherein said rounded ridge of said upper end of said sidewall substantially conforms to an inner surface of said second rim to form a peripheral seal between said container and said second rim of said lid, thereby locking said lid in place over said opening of said container.

3. The container assembly of claim 1, further comprising a downwardly-extending lifting flange, integrally depending from a portion of said second rim of said lid, said lifting flange being located on said outer surface of said sidewall proximate said upper end of said sidewall for removing said lid from said container when said lid is assembled to said container.

4. The container assembly of claim 2, further including a projection protruding inwardly from said second rim to assist in locking said lid to said container.

5. The container assembly of claim 1, wherein said first and second rims are substantially concentric and constructed of a flexible material.

6. The container assembly of claim 1, wherein said first rim is centrally inclined in a downward direction toward the center of said lid.

7. The container assembly of claim 6, wherein a diameter of said peripheral edge is less than an inside diameter of said first rim such that a mechanical lock is formed between said peripheral edge and said first rim, locking together said lid and said base.

8. A set of container assemblies comprising:

a first container assembly including (i) a first container having a first base and a first sidewall, said first sidewall having an inner surface and an outer surface and extending upwardly and outwardly from said base toward a first open upper end, said first upper end defining an opening in said container bounded by said first sidewall and first base, said first upper end having a rounded ridge extending outwardly therefrom and terminating at a first upper outermost end, and said first base having a peripheral edge extending outwardly and downwardly of the first side wall and terminating at a first lower outermost end below the base, and (ii) a first flexible lid having a first rim and a second rim, said first and second rims being radially spaced from one another and extending downwardly from an undersurface of said first lid said first lid being attachable to said first container in at least a first position proximate said peripheral edge of said first base via said first rim, and at least a second position proximate said rounded ridge of said first sidewall via said second rim thereby covering said opening of said upper end of said container, the first lid engaging only the first lower outermost end in the first position and only the first upper outermost end in the second position; and a second container assembly comprising (i) a second container having a second base and a second sidewall, said second sidewall having an inner surface and an outer surface and extending upwardly and outwardly from said second base toward a second open upper end, said second upper end defining an opening in said second container bounded by said second sidewall and said second base, said second upper end having a second rounded ridge extending outwardly therefrom and terminating at a second upper outermost end, and said second base having a second peripheral edge extending outwardly and downwardly of the second side wall and terminating at a second lower outermost end below the base, and (ii) a second flexible lid having a third and a fourth rim, said third and fourth rims being radially spaced from one another and extending downwardly from an under surface of said second lid, said second lid being attachable to said second container in at least a first position proximate said second peripheral edge of said second base via said third rim, and at least a second position proximate said second rounded ridge of said second sidewall via said fourth rim thereby covering said opening of said second upper end of said container, the second lid engaging only the second lower outermost end in the first position and only the second upper outermost end in the second position;

wherein said first container assembly is capable of being nestably received within a larger container assembly, and said second container assembly is capable of being nestably received within said first container assembly.

9. The set of container assemblies of claim 8, further comprising at least a third container assembly comprising (i) a third container having a third base and a third sidewall, said third sidewall having an inner surface and an outer surface and extending upwardly and outwardly from said third base toward a third upper end, said third upper end defining an opening in said container bound by said sidewall and said third base, said third upper end having a third rounded ridge extending therefrom, and said third base having a third peripheral edge, and (ii) a third flexible lid having a fifth rim and a sixth rim formed on an undersurface thereof, said fifth rim mechanically locking to said third peripheral edge of said third base, said third container being nestably received within said second container assembly when said third lid is assembled to said third peripheral edge of said third base.

10. The set of container assemblies of claim 8, wherein said container assemblies are dimensioned such that the height of said set of container assemblies is at most equal to the height of the largest container when each lid is attached to its respective container, and each container assembly is stored within a larger container.

* * * * *

UNITED STATES PATENT AND TRADEMARK OFFICE

CERTIFICATE OF CORRECTION

PATENT NO. : 6,729,472 B2
DATED : May 4, 2004
INVENTOR(S) : Stucke et al.

It is certified that error appears in the above-identified patent and that said Letters Patent is hereby corrected as shown below:

Column 6,
Line 5, after "extending" insert -- outwardly --.

Column 7,
Line 21, remove "s" from "rims".

Signed and Sealed this

First Day of March, 2005

JON W. DUDAS
*Director of the United States Patent and Trademark Office*